US007793537B2

(12) United States Patent
Benz et al.

(10) Patent No.: US 7,793,537 B2
(45) Date of Patent: Sep. 14, 2010

(54) METHOD OF ENGINE OIL CONSUMPTION

(75) Inventors: Frank-Michael Benz, Novi, MI (US); Jason Thomas Barton, Canton, MI (US); Michael Kennedy Rochon, Dearborn Heights, MI (US)

(73) Assignee: Detroit Diesel Corporation, Detroit, MI (US)

( * ) Notice: Subject to any disclaimer, the term of this patent is extended or adjusted under 35 U.S.C. 154(b) by 166 days.

(21) Appl. No.: 12/208,051

(22) Filed: Sep. 10, 2008

(65) Prior Publication Data

US 2010/0058847 A1 Mar. 11, 2010

(51) Int. Cl.
*G01M 15/00* (2006.01)

(52) U.S. Cl. ..... 73/114.55; 73/23.31

(58) Field of Classification Search ..... 73/23.31, 73/114.55

See application file for complete search history.

(56) References Cited

U.S. PATENT DOCUMENTS 4,321,056 A * 3/1982 Dimitroff ..... 436/43
4,990,780 A 2/1991 Lee et al.
5,445,964 A * 8/1995 Lee et al. ..... 436/60
5,531,105 A 7/1996 Leong et al.
6,294,389 B1 9/2001 Vitale, Jr. et al.
7,243,489 B2 * 7/2007 Johnson et al. ..... 60/297
7,244,395 B2 * 7/2007 Olstowski ..... 422/80
7,291,836 B2 * 11/2007 Delvigne et al. ..... 250/303
7,346,448 B2 3/2008 Graf et al.
7,428,838 B2 * 9/2008 Gugaratshan et al. ..... 73/1.06
7,533,523 B2 * 5/2009 Wang et al. ..... 60/295
2005/0268692 A1 * 12/2005 Delvigne et al. ..... 73/23.31
2006/0237640 A1 * 10/2006 Delvigne et al. ..... 250/288
2007/0209333 A1 9/2007 Kondou
2008/0156083 A1 * 7/2008 Martin ..... 73/114.56
2008/0250846 A1 * 10/2008 Taue et al. ..... 73/30.03

* cited by examiner

*Primary Examiner*—Lisa M Caputo
*Assistant Examiner*—Freddie Kirkland, III
(74) *Attorney, Agent, or Firm*—Bill C. Panagos; Rader, Fishman & Grauer PLLC

(57) ABSTRACT

The disclosure is directed to a method to determine oil consumption in an internal combustion engine that does not require extended operation of the engine in the files and is adaptable to be useful at production facilities for testing of sample engines from the line without installation of the engine into a vehicle and operating the vehicle in order to determine oil consumption of the engine during operating conditions.

8 Claims, 3 Drawing Sheets

METHOD OF ENGINE OIL CONSUMPTION

TECHNICAL FIELD

The present disclosure relates to a method to determine oil consumption in an internal combustion engine, and preferably in a compression ignition engine, such as a medium- or heavy-duty diesel engine. It has been a long felt need to assess the oil consumption in heavy duty diesel engines before the are sent to the filed in order to assess any possible warranty issues that may occur, or to assess operation of the engine over the life of the engine in a simulated environment. To this end, the engine has a coolant system in fluid communication with the engine, an oil system, with a re-circulating pump, and a piston with an expandable ring fitted to move reciprocally within at least one bore in the engine.

It has further been a need to provide for a method to determine oil consumption in a heavy duty diesel engine that does not require extended operation of the engine in the files and is adaptable to be useful at production facilities for testing of sample engines from the assembly line without installation of the engine into a vehicle and operating the vehicle in order to determine oil consumption of the engine during operating conditions.

These any other aspects of the disclosure will become apparent upon a reading of the following specification, reviewing the drawings and reading the claims.

BRIEF SUMMARY OF THE INVENTION

In one embodiment, the present disclosure is related to a method to determine engine oil consumption in an internal combustion engine having a fuel system, a cooling system, at least one piston reciprocally moveable within a piston bore, an oil reservoir in fluid communication with said bore and at least one expandable oil ring circumferentially disposed on said piston, and an exhaust system having an inlet in fluid communication with an engine exhaust manifold, and an outlet to exhaust from said engine. The steps include, fueling the engine during operation for a predetermined period of time to bring the engine oil and coolant temperature to a whole boundary predetermined temperature for a predetermined period of time;

ceasing fueling once engine has reached whole boundary condition;

motoring the engine on a dynamometer to turn crankshaft at a predetermined range of rpm;

measuring hydrocarbon levels at said exhaust outlet for a predetermined period of time determine engine oil consumption.

In another embodiment, the present disclosure may include determining that engine whole boundary conditions are reached when the coolant temperature and oil temperature are at a predetermined level. In a more specific application, the whole boundary may be reached when the oil and/or coolant temperature has reached about 80° C. The whole boundary conditions may also be determined by detecting ambient temperature; Δ pressure of CAC, and exhaust gas pressure at predetermined levels for a predetermined period of time.

When the engine, in this example a MBE 900 available from Daimler Truck North America, LLC, has reached whole boundary conditions, the fueling is ceased and the engine is motored with a dynamometer to range of from about 1800 rpm to about 2500 rpm, and preferably, at predetermined points in said range such as, for example, about 1800 rpm, 2200 rpm, and 2500 rpm to mimic transient as well as on-highway operating conditions. After about 5-6 minutes of motoring on the dynamometer, the hydrocarbon level is measured in the exhaust gas flow at the exhaust outlet for about 5-6 minutes. It is assumed after the engine has reached whole boundary conditions, any hydrocarbons present when the engine is being motored is the result of oil slipping past the oil rings on the pistons. The detected hydrocarbon level can be quantified and determined as a logarithmic trend over time and may be expressed according to the Equation (1):

$$HC_ppm(t)=5.028\ \ln(t)-13.096$$

Wherein;
HC is hydrocarbon
ppm is parts per million
t is time in seconds
lnt is logarithm over time The mass flow rate of hydrocarbons in the exhaust gas at a given time during motoring may, by use of Equation (1) be used to calculate mass flow rate of hydrocarbons in the exhaust gas at a given time, according to Equation (2):

$$HC_MFR(t) = \frac{(MW_HC)(EXH_MFR\ kg/sec)}{(3600\ sec/hr)(1000\ g/kg)(3)} \frac{}{(10^6)(MW_EXH)} HC_ppm(t)$$

Wherein;
MW_HC=MW_C+((HC_ratio)(MW_H))
EXH_MFR is the exhaust mass flow rate in kg/sec and
MW_EXH is the molecular weight of the exhaust gas.

Generally, in a dynamometer testing cell, the analytical equipment may be calibrated by propane, or some other combustible gas. Preferably, propane is used as a calibrator and, in such a case, Equation (2) is multiplied by HC_MFR(t)=(4.21258)ln(t)−10.9706 g/hr when propane is used as a calibrator.

Using the above equation, the accuracy can be verified by inputting time values in sec and comparing them to the data.

The mass flow rate of HC at a given time is not a reliable tool to measure the oil consumption during motoring over a period of time, as oil consumption is seen to be time dependent. However, HC_MFR(t) can be integrated with respect to time to gain an oil mass that was consumed over the integration interval.

The integration interval was chosen to be 24 hr. or 86400 sec. in order to make a comparison with the Drain and Weigh data. It was reported that using the drain and weight data in a 24 hr. period 778.1 g of oil were consumed.

The following definite integral was used.

$$HC_M = \frac{1}{3600}\int_0^{86400} HC_MFR(t)dt$$

$$= \frac{1}{3600}\int_0^{86400} ((4.21258)\ln(t) - 10.9706)dt$$

$$HC_M = \frac{1}{3600}\left[\begin{matrix} 4.21258t\ln(t) - \\ t - 10.9706t \end{matrix}\right|_0^{86400} = 784.8\ g$$

Note that it is necessary to divide by 3600 as the logarithmic model was obtained using a seconds as a time stamp.

The result is close to the data from a Drain and Weigh especially if a g/hr. rate is calculated, and verifies the accuracy of the mathematical model used.

DETAILED DESCRIPTION OF THE INVENTION

Figure 1:
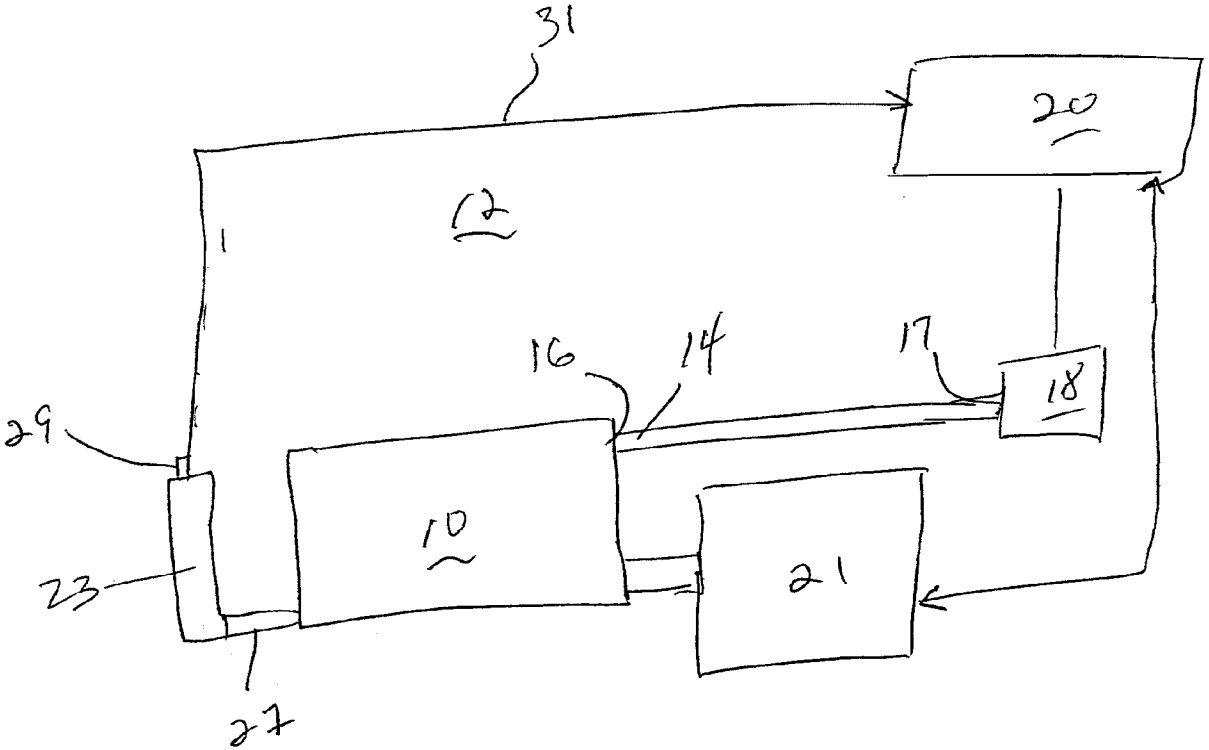
FIG. 1 is a schematic representation of an engine in a test cell.

Turning now to the drawings wherein like numbers refer to like structures, and particularly to FIG. 1, there is disclosed, schematically, an engine 10 in a test cell 12 having an exhaust gas manifold 14 with an inlet 16 and an outlet 17. The outlet 17 is in close, fluid communication with the testing apparatus 18, which include an exhaust gas conduit to keep the exhaust gas outlet in fluid communication with a computer 20, and a dynamometer 21 controlled by the computer and cooperatively engageable with the crank shaft of the engine, to motor the engine at any engine speed, measured in rpm, desired. The engine has a coolant system 23, in fluid communication with the engine through conduit 27. A temperature sensor 29 is in electronic communication 31 with the computer Internally, and not shown, but easily understood by those skilled in the art, the engine has at least on cylinder bore with a piston reciprocally movable therein, Circumferentially positioned on the piston is at least one expandable piston ring. The piston is attached to the crank by a connecting rod as is customary in internal engine design, and is moveable within the bore when the crankshaft is rotated.

Figure 2:
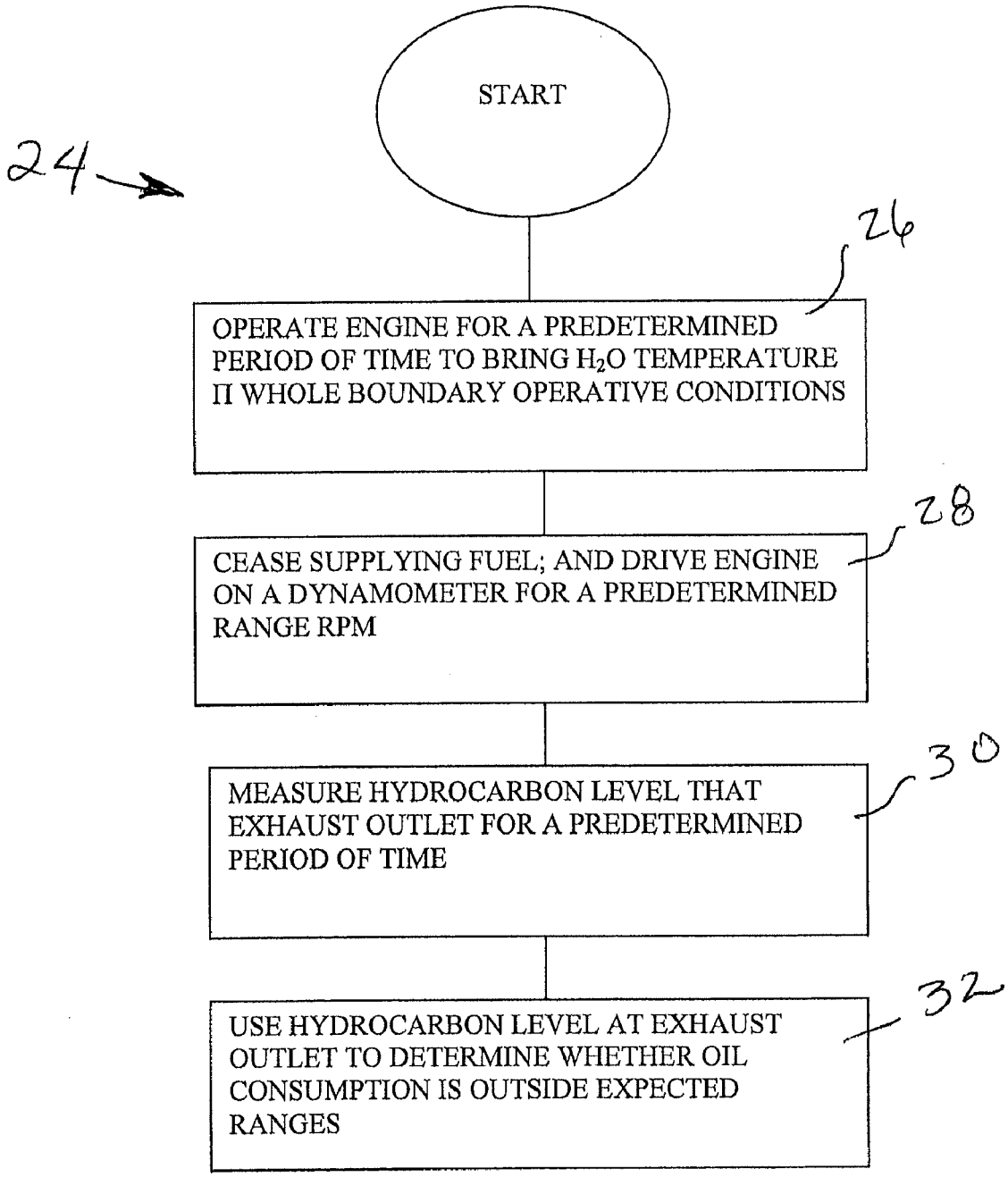
FIG. 2 is a schematic representation of a flow chart detailing the step in method for determine oil consumption according to the present disclosure.

Turning to FIG. 2, there is disclosed a schematic representation of one method 24 to determine the oil consumption of an internal combustion engine. Specifically, step 26 is fueling the engine to operate it for a predetermined period of time and to predetermined operating conditions such that the engine reaches whole boundary condition. To that end, the engine fluids may be measured for temperature to determine whether they have reached a predetermined level. For example, the oil and/or coolant temperature may be measured until is abut 80° C. for a predetermined period of time, which may be about 5-6 minutes of engine fueling operation. In another embodiment, or in addition to the preceding, whole boundary conditions are determined using ambient temperature; Δ pressure of CAC, and exhaust gas pressure are at predetermined levels for a predetermined period of time.

Once it is determined that the engine has reached a whole boundary condition, step 28 is ceasing fueling and begin motoring the engine on a dynamometer for a predetermined period of time at a predetermine range of engine speeds. Generally, the dynamometer turns the engine crank at some range of speeds, or at various steady speeds for predetermined periods of time in order to mimic driving conditions that may be expected to occur during service life of the engine in a vehicle. In some applications, it may be desirable to motor the engine with a dynamometer at a range of about 1800 rpm to about 2500 rpm. In other situations, it may be preferable to run the engine for a predetermined period of time at various engine speeds, for example, 1800 rpm, 2200 rpm and 2500 rpm.

As the engine is being motored, the exhaust gas outlet is monitored at step 30 for hydrocarbon content. Normally, after the engine has no fuel added to it, on would expect that no or minimal hydrocarbons could be detected at the exhaust outlet. It is assumed that any hydrocarbons that are detected at the exhaust outlet during engine motoring is the result of oil "blowing by" the rings on the pistons during reciprocation within the bore. The hydrocarbons are detected and quantified in a computer at step 32 to determine the oil consumption that may be expected by the engine during normal engine operation.

Generally, the engine oil consumption may be expressed as a mathematical relation and may be linear, logarithmic or any other mathematical means to express the loss of mass. When considered as a logarithmic trend over time it may be expressed according to the Equation (1):

$$HC_ppm(t)=5.028\ \ln(t)-13.096$$

Wherein;

HC is hydrocarbon ppm is parts per million t is time in seconds ln t is logarithm over time.

Equation (1) may be used to calculate mass flow rate of hydrocarbons in the exhaust gas at a given time, according to Equation (2):

$$HC_MFR(t)=\frac{(MW_HC)(EXH_MFR\ kg/sec)(3600\ sec/hr)(1000\ g/kg)(3)}{(10^6)(MW_EXH)}HC_ppm(t)$$

Wherein;

MW_HC=MW_C+((HC_ratio)(MW_H))

EXH_MFR is the exhaust mass flow rate in kg/sec and

MW_EXH is the molecular weight of the exhaust gas.

Generally such dynamometer testing apparatus' are calibrated prior to testing of an engine to determine operating conditions, It has been determined that if the calibrator is propane, Equation (2) is multiplied by 3.

To demonstrate one such determination of engine oil consumption, and not to limit the description given, if it assumed HC_ratio=1.8, and assuming an HC ratio similar to that of diesel fuel,

MW_C=12.011

MW_H=1.00794

MW_HC=13.8

MW_EXH=29 (average molecular wait of non-humid atmosphere), and substituting the above constant rate equation 2, yields $$HC_MFR(t)=(0.837708)HC_ppm(t)g/hr \quad (2)$$

And substituting the above constants into Equation 1 yields $$HC_MFR(t)=(4.21258)\ln(t)-10.9706\ g/hr \quad (3)$$

Using the above equation, the accuracy can be verified by inputting time values in sec and comparing them to the data.

The mass flow rate of HC at a given time is not a reliable tool to measure the oil consumption during motoring over a period of time, as oil consumption is seen to be time dependent. However, HC_MFR(t) can be integrated with respect to time to gain an oil mass that was consumed over the integration interval.

The integration interval was chosen to be 24 hr. or 86400 sec. in order to make a comparison with the Drain and Weigh data. It was reported using the Drain and Weight data, that in a 24 hr. period 778.1 g of oil were consumed.

The following definite integral was used.

$$\mathrm{HC_M} = \frac{1}{3600}\int_0^{86400} \mathrm{HC_MFR}(t)dt$$

$$= \frac{1}{3600}\int_0^{86400} ((4.21258)\ln(t) - 10.9706)dt$$

$$\mathrm{HC_M} = \frac{1}{3600}\left[\begin{matrix} 4.21258t\ln(t) - \\ t - 10.9706t \end{matrix}\right|_0^{86400} = 784.8 \text{ g}$$

Note that it is necessary to divide by 3600 as the logarithmic model was obtained using a seconds as a time stamp.

The result is very close to the data from the Drain and Weigh especially if a g/hr. rate is calculated.

Figure 3:
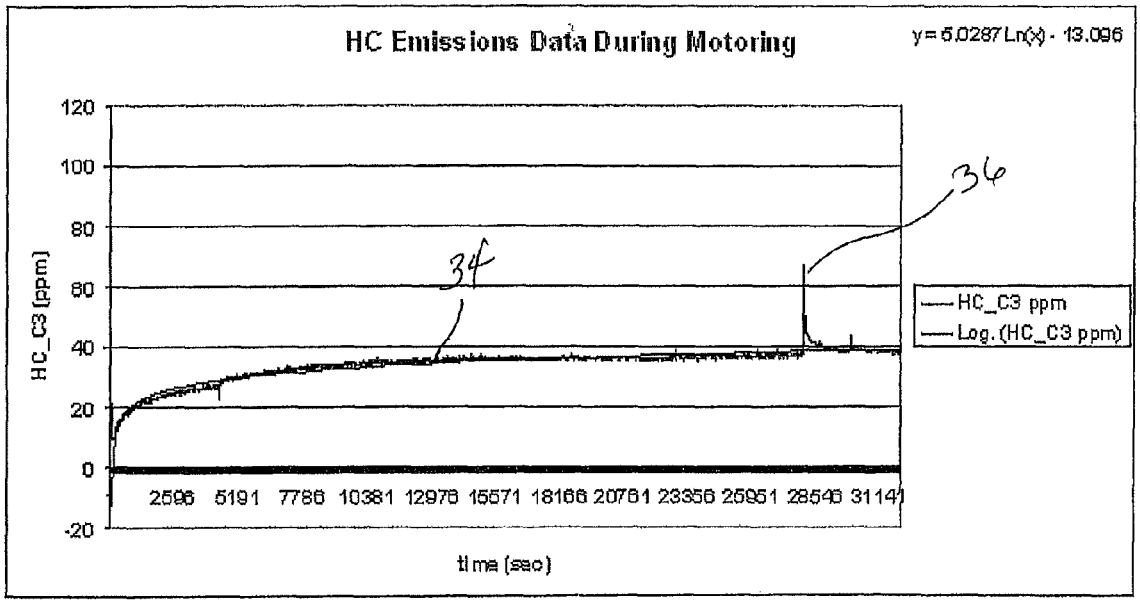
FIG. 3 is a graph showing the HC emissions during maturing of a heavy-duty diesel engine.

FIG. 3 is a graph showing the HC Emissions during motoring of a heavy duty diesel engine. The data can be seen to have a logarithmic trend and shows 8 hours of 1 Hz HC emissions data during motoring conditions. The x axis is time in seconds, and the y axis is Hydrocarbons in parts per million. It can be seen that when the engine reaches whole boundary conditions and the dynamometer is motoring the engine, the level of hydrocarbons measured 34 is relatively level at about 40 ppm over the time measured, with an anatomy of data at 36, which is one data point out of sync with the other data points that form the line 34 and is dismissible as such. Thus, it can be seen that by motoring the engine, using the calculations as set forth about, the oil consumption may be determined for the engine prior to placing it in service.

The words used in the specification are words of description, and not words of limitation. Many variations and modifications are possible without departing form the scope and spirit of the invention as set forth in the appended claims.

What is claimed as new and desired to be protected by Letters Patent of the United States is:

1. A method to determine engine oil consumption in an internal combustion engine having a fuel system, a cooling system, at least one piston reciprocally moveable within a piston bore, an oil reservoir in fluid communication with said bore and at least one expandable oil ring circumferentially disposed on said piston, and an exhaust system having an inlet in fluid communication with an engine exhaust manifold, and an outlet to exhaust from said engine, fueling the engine during operation for a predetermined period of time to bring the engine oil and coolant temperature to a whole boundary predetermined temperature for a predetermined period of time;

ceasing fueling once engine has reached whole boundary condition;

motoring the engine on a dynamometer to turn crankshaft at a predetermined range of rpm;

measuring hydrocarbon levels at said exhaust outlet for a predetermined period of time to determine engine oil consumption.

2. The method of claim 1, wherein said engine whole boundary conditions are reached when the coolant and oil temperature are at a predetermined level.

3. The method of claim 1, wherein whole boundary conditions are determined using ambient temperature; Δ pressure of CAC, and exhaust gas pressure are at predetermined levels for a predetermined period of time.

4. The method of claim 1, wherein said coolant predetermined temperature is about 80° C.

5. The method of claim 1, further including motoring said engine with a dynamometer to range of about 1800 rpm.

6. The method of claim 1, further including motoring said engine with a dynamometer to a range of about 2200 rpm.

7. The method of claim 1, further including motoring said engine with a dynamometer at a range of about 2500 rpm.

8. The method of claim 1, wherein said hydrocarbon level is measured in said exhaust for about 5-6 minutes.

* * * * *